US008594537B2

(12) United States Patent
Hirota

(10) Patent No.: US 8,594,537 B2
(45) Date of Patent: Nov. 26, 2013

(54) POWDER CARRIER SCREW, DEVELOPMENT DEVICE AND IMAGE FORMING DEVICE USING THE POWDER CARRIER SCREW

(75) Inventor: Hiroshi Hirota, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 438 days.

(21) Appl. No.: 12/796,187

(22) Filed: Jun. 8, 2010

(65) Prior Publication Data

US 2010/0310275 A1 Dec. 9, 2010

(30) Foreign Application Priority Data

Jun. 9, 2009 (JP) ..... 2009-138389

(51) Int. Cl.
*G03G 15/08* (2006.01)

(52) U.S. Cl.
USPC ..... 399/256; 222/412; 198/677

(58) Field of Classification Search
USPC ..... 399/254, 256; 198/677
See application file for complete search history.

(56) References Cited

U.S. PATENT DOCUMENTS

| | | | | |
|---|---|---|---|---|
| 3,219,178 | A * | 11/1965 | Mayrath | 198/659 |
| 4,328,913 | A * | 5/1982 | Whiteman | 222/413 |
| 4,399,906 | A * | 8/1983 | Millsap | 198/662 |
| 5,264,900 | A * | 11/1993 | Momiyama et al. | 399/256 |
| 7,904,014 | B2 | 3/2011 | Umehara et al. | |
| 2010/0111572 | A1 * | 5/2010 | Hori et al. | 399/260 |

FOREIGN PATENT DOCUMENTS

| | | |
|---|---|---|
| JP | 60-89517 | 5/1985 |
| JP | 3-180876 | 8/1991 |
| JP | 5-35161 | 2/1993 |
| JP | 5-119627 | 5/1993 |
| JP | 6-314021 | 11/1994 |
| JP | 7-140871 | 6/1995 |
| JP | 11-52725 | 2/1999 |
| JP | 11-223986 | 8/1999 |
| JP | 2008-68262 | 3/2008 |
| JP | 2009-20428 | 1/2009 |

* cited by examiner

*Primary Examiner* — Walter L Lindsay, Jr.
*Assistant Examiner* — Benjamin Schmitt
(74) *Attorney, Agent, or Firm* — Cooper & Dunham LLP

(57) ABSTRACT

A powder carrier screw includes a rotation shaft which is provided along a path which carries powder such as toner and is rotatably supported by a container forming the path, the rotation shaft having one end from which a rotation driving force is applied, a coil which is provided in a spiral form along an outer circumference of the rotation axis, the coil having a shaft center of the rotation shaft as a shaft center and having both end portions joined to both end portions of the rotation shaft, and the coil rotating along the rotation of the rotation shaft, a thick portion which is provided in at least one end portion of the coil, the thick portion having a thickness larger than a thickness of a general portion of the coil, and a coil welded portion in which the thick portion and the rotation shaft are welded.

10 Claims, 8 Drawing Sheets

POWDER CARRIER SCREW, DEVELOPMENT DEVICE AND IMAGE FORMING DEVICE USING THE POWDER CARRIER SCREW

PRIORITY CLAIM

The present application is based on and claims priority from Japanese Patent Application No. 2009-138389, filed on Jun. 9, 2009, the disclosure of which is hereby incorporated by reference in its entirety.

BACKGROUND OF THE INVENTION

1. Field of the Invention

The present invention relates to a powder carrier screw which is suitable for carrying, collecting and agitating powder such as toner and developer for use in a development device and a waste toner mechanism in an image forming device forming a toner image such as a copier and a printer.

2. Description of the Related Art

A powder carrier screw has been conventionally used for carrying powder such as toner (for example, JP H11-223986A). This conventional powder carrier screw includes a rotation shaft, which rotates upon input of a rotation driving force, and a spiral portion which is wound about the rotation shaft in a spiral manner. The end portion of the spiral portion is joined to the rotation shaft by welding or soldering.

Regarding such a powder carrier screw, the present inventor invented a powder carrier screw OA (hereinafter, this is referred to as a prior powder carrier screw OA) as the first invention as illustrated in FIG. 8.

This prior powder carrier screw OA is applied to a toner carrier device OB. In this toner carrier device OB, as is known in the art, the powder carrier screw OA is rotatably arranged inside a tube-like container 04. This container 04 has on one end portion a toner entrance 04*a* and on the other end portion a toner exit 04*b*.

The prior powder carrier screw OA includes a rotation shaft 010 and a coil 01 which is formed in a spiral form and carries toner and developer by using the rotation of the rotation shaft.

The rotation shaft 010 includes a driving shaft 02 to which a rotation driving force is input and a supporting shaft 03 having a one end supported by the driving shaft 02. The diameter of the driving shaft 02 is larger than that of the supporting shaft 03. The supporting shaft 03 is joined to the end portion of the coil 01.

One end of the driving shaft 02 projects from the container 04, and a gear 05 which inputs the rotation driving force is attached to that one end. The powder carrier screw OA rotates upon the input of the rotation driving force to the gear 05.

If the powder carrier screw OA rotates, the toner and the developer from the toner entrance 04*a* are pushed by a spiral coil face 01*a* formed on the rotation coil 01 to be moved, and are carried to the toner exit 04*b*.

The supporting shaft 03 is joined to the end portion of the coil 01, so that the rotative force of the supporting shaft 03 is transferred to the end of the coil 01. Moreover, even if a large rotation load is generated in the coil 01, the rigidity of the coil 01 is maintained.

Next, the joining structure of the coil 01 and the driving shaft 02 of the prior powder carrier screw OA will be described. JP H11-223986A and the like describe that the coil 01 and the driving shaft 02 are joined by means of soldering and welding.

FIG. 9 illustrates an example in which the coil 01 and the driving shaft 02 are joined by soldering. In this soldering, it is necessary to apply solder 08 over a sufficient length along the spiral form of the coil 01, in order to enhance the joining strength.

Next, the joining structure of the driving shaft 02 and the supporting shaft 03 will be described. When joining the driving shaft 02 and the supporting shaft 03, as illustrated in FIG. 10, the driving shaft 02 and the supporting shaft 03 are joined by solder 09 in a state in which the supporting shaft 03 is fitted to a hole 02*b* (refer to FIG. 11) formed in the shaft center of the driving shaft 02, so that an increased joining strength can be obtained.

In this case, as illustrated in FIG. 11, the hole 02*b* to which the supporting shaft 03 is fitted is provided in the shaft center of the end face 02*a* on a side into which the coil 01 is inserted. The supporting shaft 03 and the end face 02*a* of the driving shaft 02 are joined by the solder 09 in a state in which the supporting shaft 03 is fitted to the hole 02*b* as illustrated in FIG. 10.

In this joining structure, it is necessary to apply the solder 09 over the entire circumference of the supporting shaft 03, in order to enhance the joining strength. In this case, as illustrated in FIG. 11, a spot facing portion 02*c* is provided in the entrance of the hole 02*b* of the driving shaft 02. The solder 09 enters into the spot facing portion 02*e*, so that an anchor effect can be obtained; thus, the joining strength can be further creased.

However, as illustrated in FIG. 9, in the prior powder carrier screw OA, the coil 01 and the driving shaft 02 are joined by the soldering. For this reason, the prior powder carrier screw OA has a problem in that the process which applies the solder 08 is complex, resulting in the deterioration in the productivity. Moreover, the operation environment is undesirable because flux is evaporated in the manufacturing. Furthermore, as illustrated in FIG. 12, if a spiral coil 011 having a narrow pitch is used, solder 08*b* fills in the spiral groove which is a path for carrying toner and developer, so that the carrying performance may be lost.

In addition, a heat treatment such as a nitriding treatment and a surface treatment may be applied to the driving shaft 02, in order to enhance abrasion resistance and corrosion resistance. When such a treatment is applied, the solder 08 is removed by the surface treatment, disenabling the joining. To combat this, the surface around the solder is shaved, but such an operation deteriorates a necessary characteristic such as corrosion resistance.

In the structure in which the coil 01 and the driving shaft 02 are joined by the soldering as described above, it is desired to improve the productivity and the operation environment. Moreover, it is difficult to firmly join the coil and the driving shaft after ensuring the carrying performance and the abrasion resistance.

Consequently, in order to solve the above problems, it is considered to use welding instead of using the soldering. When welding the coil 01 and the driving shaft 02, a condition which can weld the thicker driving shaft 02 is set as a general welding condition. However, by such a condition, the temperature of the thinner coil 01 is excessively increased, so that the coil 01 may be melted. For this reason, in fact, it is difficult to use the welding for the joining of the coil 01 and the driving shaft 02.

Moreover, as illustrated in FIG. 8, there may be a case in which a flange 02*f* provided in the driving shaft 02 has contact with the inner circumference of the container 04 for positioning, and the flange 02*f* rotates while having contact with the container 04 in the rotation. In such a configuration, if the carrying area of toner and developer continues just before the flange 02*f*, it is necessary to bring the leading end of the coil 01 into contact with the flange 02*f* for joining. In this case, the thinner flange 02*f* may be deformed or be damaged by the high heat of the welding, so that the positioning accuracy may be deteriorated. In addition, if the powder carrier screw OA rotates, the deformed flange 02*f* has contact with the container 04, which has a negative effect on the rotation. Consequently, it is also difficult to use the welding for the joining between the coil 01 and the driving shaft 02.

If the welding is used for the joining of the driving shaft 02 and the supporting shaft 03, where the difference between the diameter of the driving shaft 02 and the diameter of the supporting shaft 03 is large, the supporting shaft 03 may be melted by the high heat in the welding. For this reason, it is also difficult to use the welding for the joining of the driving shaft 02 and the supporting shaft 03.

SUMMARY OF THE INVENTION

It is, therefore, an object of the present invention to provide a powder carrier screw, which can effectively join at least a coil and a rotation shaft by means of welding which is advantageous in carrying performance of powder, productivity, operation environment in manufacturing, abrasion resistance after manufacturing, corrosion resistance and the like, a development device and an image forming device using the powder carrier screw.

In order to achieve the above object, the present invention provides a powder carrier screw, including: a rotation shaft which is provided along a path which carries powder such as toner and is rotatably supported by a container forming the path, the rotation shaft having one end from which a rotation driving force is applied; a coil which is provided in a spiral form along an outer circumference of the rotation axis, the coil having a shaft center of the rotation shaft as a shaft center and having both end portions joined to both end portions of the rotation shaft, and the coil rotating along the rotation of the rotation shaft; a thick portion which is provided in at least one end portion of the coil, the thick portion having a thickness larger than a thickness of a general portion of the coil; and a coil welded portion in which the thick portion and the rotation shaft are welded.

Preferably, the rotation shaft has a flange on an outer circumference thereof, the thick portion is located in a position capable of transferring heat to the flange in the welding of the thick portion to the rotation shaft, the flange includes a first flange portion arranged on a side close to the thick portion and a second flange portion arranged on a side far from the thick portion, and the first flange portion and the second flange portion have a difference in outer diameter.

Preferably, the rotation shaft includes a driving shaft having one end to which the rotation driving force is applied and a supporting shaft which is formed in a shaft form having a diameter smaller than that of the driving shaft, is concentrically joined to the other end of the driving shaft, and rotates together with the driving shaft, and the coil welded portion is formed in an outer circumference of the driving shaft.

Preferably, the powder carrier screw includes a supporting shaft fitting hole formed in a shaft center of the other end of the driving shaft, and a supporting shaft welded portion in which an outer circumference of the supporting shaft and a circumference of an opening portion of the supporting shaft fitting hole are joined by welding in a state in which the supporting shaft is fitted to the supporting shaft fitting hole.

Preferably, the other end of the driving shaft includes a small-diameter portion having a diameter smaller than that of a general portion of the driving shaft and the supporting shaft fitting hole, and the supporting shaft welded portion is formed by welding the small-diameter portion and the supporting shaft.

The present invention also provides a development device, including; a container forming a path which carries developer including toner; and the above powder carrier screw rotatably supported to the container.

The present invention also provides an image forming device including the above development device.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENT

Figure 1:
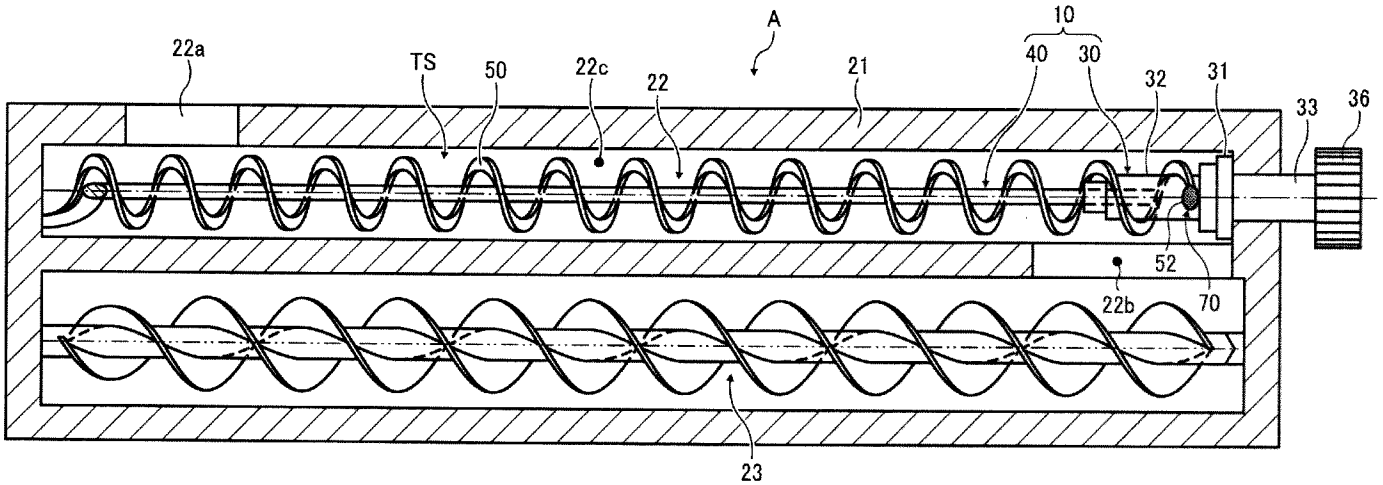
FIG. 1 is a sectional view illustrating a development device A in which a toner carrier screw TS of Embodiment 1 is introduced.

Hereinafter, embodiments of the present invention will be described with reference to the drawings. As illustrated in FIG. 1, a powder carrier screw, includes: a rotation shaft 10 which is provided along a path 22*c* which carries powder such as toner and is rotatably supported by a container 21 forming the path 22*c*, the rotation shaft 10 having one end from which a rotation driving force is applied; a coil 50 which is provided in a spiral form along an outer circumference of the rotation axis 10, the coil 50 having a shaft center of the rotation shaft 10 as a shaft center and having both end portions joined to both end portions of the rotation shaft 10, and the coil 50 rotating along the rotation of the rotation shaft, a thick portion 52 which is provided in at least one end portion of the coil 50; the thick portion 52 having a thickness larger than a thickness of a general portion of the coil 50; and a coil welded portion 70 in which the thick portion 52 and the rotation shaft 10 are welded.

Embodiment 1

A toner carrier screw (powder carrier screw) TS of Embodiment 1 will be described with reference to FIGS. 1-5.

Figure 4:
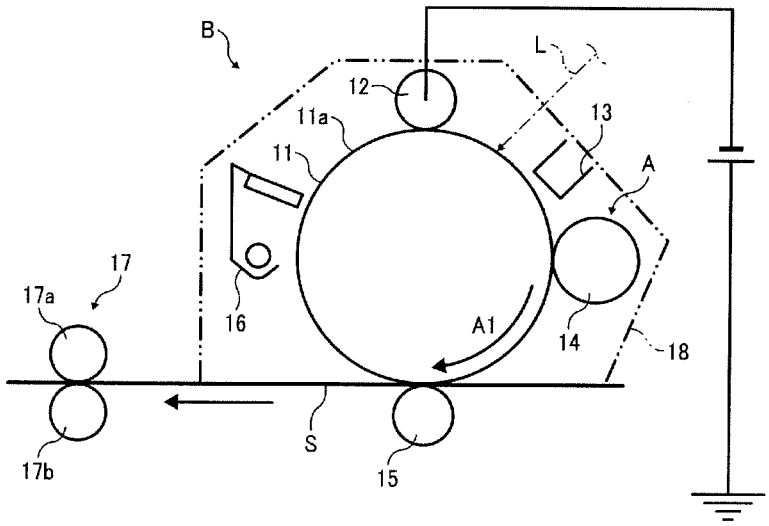
FIG. 4 is a schematic view illustrating the configuration of an image forming device B in which the toner carrier screw TS of Embodiment 1 is introduced.
Figure 5:
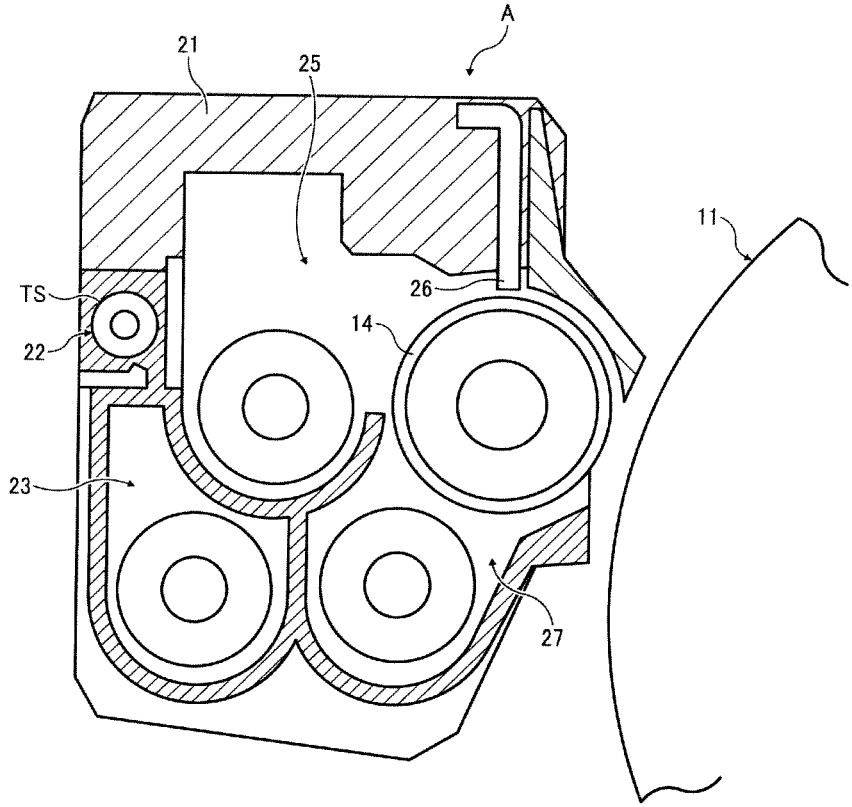
FIG. 5 is a sectional view illustrating a development device A in which the toner carrier screw TS of Embodiment 1 is introduced.

The toner carrier screw TS of Embodiment 1 is applied to a development device A illustrated in FIG. 5. This development device A is provided in an image forming device B illustrated in FIG. 4.

(Configuration of Image Forming Device B)

First, the configurations of the image forming device 13 will be simply described.

As illustrated in FIG. 4, the image forming device B includes a photoreceptor drum 11, a charging roller 12, a surface potential meter 13, a development roller 14, a transfer roller 15, a cleaner 16 and a fusing unit 17.

The photoreceptor drum 11, the charging roller 12, the surface potential meter 13, the development roller 14 and the cleaning station 16 are integrally housed in a housing 18 illustrated by the two-dot chain line to be formed as a process cartridge.

The photoreceptor drum 11 has a cylindrical shape. An electrostatic latent image is formed on a surface 11*a* of the photoreceptor drum 11. This photoreceptor drum 11 rotates in the arrow A1 direction about an axis extending in the depth direction of the figure by a driving force from a not-shown driving mechanism. The charging roller 12 is provided to face the photoreceptor drum 11.

The charging roller 12 charges upon power supply, and uniformly charges the surface 11*a* of the photoreceptor drum 11 at a desired potential. In this case, since the photoreceptor drum 11 rotates in the arrow A1 direction, the surface portion which becomes a downstream side of the portion facing the charging roller 12 in the surface 11*a* of the photoreceptor drum 11 in the rotation direction is uniformly charged in series according to the rotation. Then, by the irradiation of laser light L having image information and the like, an electrostatic latent image having an electric potential distribution according to the image information and the like is formed on the surface 11*a* of the photoreceptor drum 11.

The surface potential meter 13 detects a potential (electric potential distribution) of an electrostatic latent image formed on the surface 11*a* of the photoreceptor drum 11.

The development roller 14 transfers loner to the electrostatic latent image on the photoreceptor drum 11. If a portion of the surface 11*a* of the photoreceptor drum 11 in which the electrostatic latent image is formed passes the development roller 14, toner according to the electric potential distribution of the electrostatic latent image is transferred to the surface 11*a* of the photoreceptor drum 11, and a toner image having a concentration distribution according to the electrostatic latent image is visualized (developed). This development roller 14 is provided in the development device A (refer to FIG. 5).

The transfer roller 15 transfers onto a recording sheet S the toner image visualized on the surface 11*a* of the photoreceptor drum 11. The recording sheet S fed toward the photoreceptor drum 11 at a predetermined timing passes while being sandwiched between the photoreceptor drum 11 and the transfer roller 15, so that the recording sheet S is compressed by the photoreceptor drum 11, and the toner image is transferred onto the recording sheet S.

The fusing unit 17 fuses the toner image on the recording paper S, and includes a heating roller 17*a* and a pressure roller 17*b*. The heating roller 17*a* includes a hollow cylindrical cored bar made of an aluminum, for example and an anti-adhesive layer made of a fluorine-containing layer, for example, which is provided on the outer circumferential face of the cored bar and prevents the adhesion of toner. The heating roller 17*a* includes a heater such as a halogen lamp. The heater is provided in the hollow portion of the cored bar (not shown) along the rotation central axis. The heating roller 17*a* is heated from the inside thereof by the radiation heat. The pressure roller 17*b* is arranged to be parallel to the heating roller 17*a* and to press the heating roller 17*a*.

The recording sheet S fed to the fusing unit 17 passes between the pressure roller 17*b* and the heating roller 17*a*. The toner transferred onto the recording sheet S is sandwiched between the pressure roller 17*b* and the heating roller 17*a* to be compressed while being softened by the heat of the heating roller 17*a*. Thereby, the toner image is fused on the recording sheet S.

(Configuration of Development Device A)

Next, the configuration of the development device A will be described. The development device A uses a two-component developer made of toner and magnetic carriers. As illustrated in FIG. 5, the development device A includes a development tank 21 which contains the developer. The development tank 21 includes a toner carrier 22 having a toner carrier screw TS which supplies toner, an agitation screw section 23 which obtains developer by mixing magnetic carriers into toner, a supply screw section 25 which supplies the developer mixed in the agitation screw section 23 to the development roller 14, a development doctor blade 26 which controls a thickness of a developer layer transferred onto the development roller 14, and a collection screw section 27 which collects the developer from the development roller 14.

(Toner Carrier 22)

Next, the toner carrier 22 having the toner carrier screw TS of Embodiment 1 will be described. As illustrated in FIG. 1, the toner carrier 22 includes a carrier path 22*c* which carries toner. The carrier path 22*c* extends in the developer tank 21 as a container in the right and left direction in FIG. 1. The toner flows into the carrier path 22*c* from the toner entrance 22*a* provided in one end in the shaft direction, and is carried to the toner exit 22*b* provided in the other end in the shaft direction by the toner carrier screw TS. The toner is carried to the agitation screw section 23 from the toner exit 22*b*.

(Toner Carrier Screw TS)

Next, the toner carrier screw TS of Embodiment 1 will be described in details. The toner carrier screw TS includes a rotation shaft 10 and a coil 50.

Figure 2A:
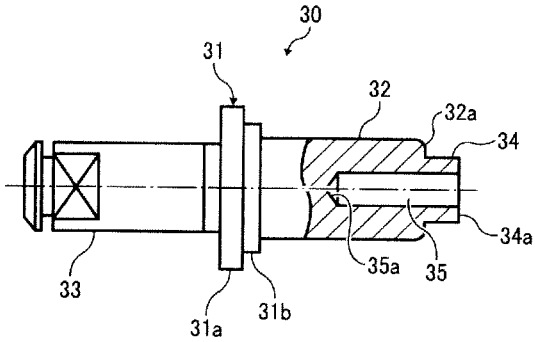
FIG. 2A is a sectional view illustrating a part of a driving shaft 30 of the toner carrier screw TS of Embodiment 1 in the shaft direction.

The rotation shaft 10 includes a driving shaft 30 and a supporting shaft 40. The driving shaft 30 is made of a metal, and is formed in a bar form as illustrated in FIG. 2A. The driving shaft 10 concentrically includes an insertion portion 32 which is inserted into the inner circumference of the coil 50 and a projection 33 which projects outside from the developer tank 21 (refer to FIG. 1). The driving shaft 30 also includes an intermediate flange 31 provided between the projection 33 and the insertion portion 32.

The flange 31 includes a small-diameter flange portion (first flange portion) 31*b* and a large-diameter flange portion (second flange portion) 31*a*. This flange 31 is formed by a cutting process or a header machine process.

The insertion section 32 includes a leading end surface 32*a*. The leading end surface 32*a* includes a small-diameter portion 34 having a diameter smaller than the outer diameter of the insertion section 32 and larger than the diameter of the supporting shaft 40. The small-diameter section 34 includes a leading end surface 34*a*. The leading end surface 34*a* includes a supporting shaft fitting hole 35. This hole 35 is provided at a predetermined diameter along the shaft center of the insertion section 32. In addition, this hole 35 has an inner diameter into which the supporting shaft 40 can be fitted.

As illustrated in FIG. 1, the leading end of the projection 33 is provided with a gear 36 to which a rotation driving force from a not-shown driving source is input.

Figure 2B:
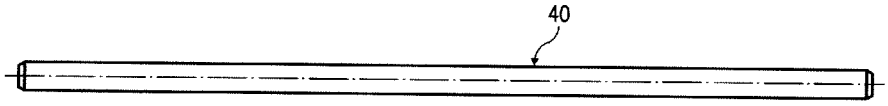
FIG. 2B is a side view illustrating a supporting shaft 40 of the toner carrier screw TS of Embodiment 1.
Figure 3:
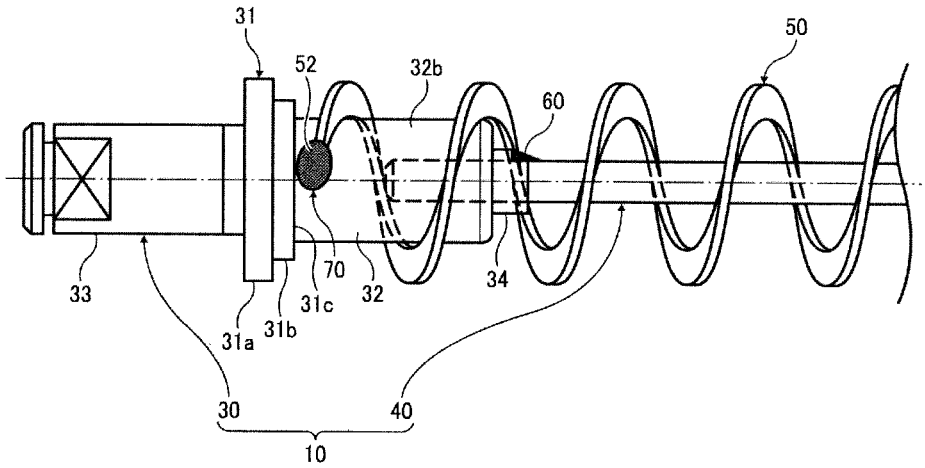
FIG. 3 is an enlarged side view illustrating a joined portion of the coil 50 and the driving shaft 30 in the toner carrier screw TS of Embodiment 1.

As illustrated in FIG. 2B, the supporting shaft 40 is made of a metal round bar which is cut at a predetermined length. The supporting shaft 40 is inserted into the supporting shaft fitting hole 35 to hit a bottom portion 35*a* of the hole 35, and is fitted to the hole 35. As illustrated in FIG. 3, the supporting shaft 40 is welded to the small-diameter portion 34 of the driving shaft 30 by a supporting shaft welded portion 60. The number of welded points of the supporting shaft welded portion 60 is a single point. For this welding, a TIG (tungsten inert gas) welding machine which is suitable for welding a fine member is used. In addition, the depth of the supporting shaft fitting hole 35 is set to a measurement in which the length from the flange 31 to the leading end of the supporting shaft 40 becomes a previously set length after the supporting shaft is inserted into the hole 35.

Figure 2C:
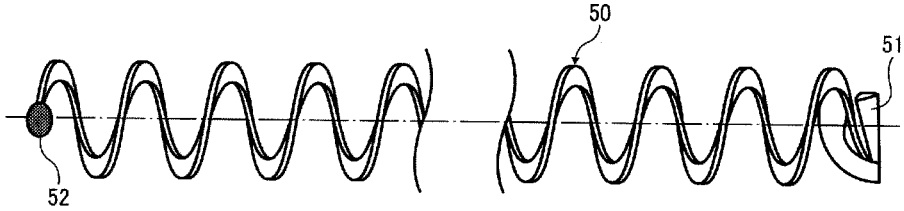
FIG. 2C is a side view illustrating a coil 50 of the toner carrier screw TS of Embodiment 1.

The coil 50 is made of a belt-like metal plate which is formed in a spiral form along the shaft center such that the front and back faces of the metal plate face the direction along the axis direction as illustrated in FIG. 2C. The leading end portion of the coil 50 is provided with a turned edge portion 51 which is turned up toward the shaft center in a state in which the front and back faces face the radial direction in order to be joined to the supporting shaft 40. On the other hand, the base end portion of the coil 50 is provided with a thick portion 52 having a thickness larger than that of the other general portion.

The base end portion of the coil 50 is joined to the driving shaft 30 and the leading end portion of the coil 50 is joined to the supporting shaft 40. As illustrated in FIG. 3, the insertion portion 32 of the driving shaft 30 is inserted inside the coil 50, and the thick portion 52 is welded to the insertion portion 32 in a state in which the thick portion 52 has contact with the outer circumference 32*b* of the insertion portion 32 and a side face 31*c* of the small-diameter flange portion 31*b*, so that a coil welded portion 70 is formed. More specifically, after the thick portion 52 and the outer circumference 32*b* are welded by heating the thick portion 52 from a not-shown welder, that portion is hardened, so that the coil welded portion 70 is obtained. In this case, the side face 31*c* of the small-diameter flange portion 31*b* may be welded together. Accordingly, the base end portion of the coil 50 and the driving shaft 30 are joined.

On the other hand, the leading end portion of the coil 50 and the supporting shaft 40 are joined by welding or soldering the turned edge portion 51 of the leading end portion of the coil 50 to the leading end of the supporting shaft 40. In the welding, since the supporting shaft 40 has a diameter relatively smaller than that of the driving shaft 30, the supporting shaft 40 does not melt even if the thickness of the turned edge portion 51 and the thickness of the general portion of the thinner coil 50 are the same.

Function of Embodiment 1

Next, a manufacturing procedure of the toner carrier screw TS of Embodiment 1 will be described.

a) Joining of Driving Shaft 30 and Supporting Shaft 40

When joining the supporting shaft 40 to the driving shaft 30, a supporting shaft fitting process is at first performed. In this supporting shaft fitting process, the supporting shaft 40 is inserted into the supporting shaft fitting hole 35 to hit the bottom portion 35*a* of the supporting shaft fitting hole 35, so that the supporting shaft 40 is fitted to the hole 35. By this fitting, the shaft center of the supporting shaft 40 conforms to the shaft center of the driving shaft 30. Moreover, by inserting the supporting shaft 40 into the supporting shaft fitting hole 35 to hit the bottom portion 35*a* of the hole 35, the measurement of the supporting shaft 40 which projects from the driving shaft 30 becomes a set measurement, so that a process which adjusts such a measurement can be omitted.

Next, a supporting shaft welding process is performed. In this supporting shaft welding process, the outer circumference of the supporting shaft 40 and the leading end face 34*a* of the small-diameter portion 34 of the driving shaft 30 are welded at a single point by a TIG welder, so that the supporting shaft welded portion 60 is formed. Moreover, in the TIG welder, a welding operation of the base material by arc and a welding operation of the welding bar can be independently performed. Accordingly, the TIG welding is advantageous in that the melting and the welding amount can be easily adjusted, the oxidizing and the nitriding of a welding metal by air can be prevented by sufficiently conducting shielding with inactive gas, and the generation of sputter and fumes can be reduced.

The small-diameter portion 34 has a diameter smaller than that of the general portion of the insertion section 32, and the difference between the diameter of the small-diameter portion 34 and the diameter of the supporting shaft 40 is small. For this reason, the difference between the heat capacity of the supporting shaft 40 and heat capacity of the small-diameter portion 34 is also small, and the supporting shaft 40 and the small-diameter portion 34 are welded at a similar temperature. Therefore, compared to a case in which the supporting shaft 40 is welded to the leading end face 32*a* of the insertion portion 32, the supporting shaft 40 can be prevented from being excessively welded by high heat. Additionally, the excessive welding of the supporting shaft 40 is prevented because the supporting shaft welded portion 60 is a single point. Consequently, the supporting shaft 40 can be joined to the driving shaft 30 by the welding.

Figure 11:
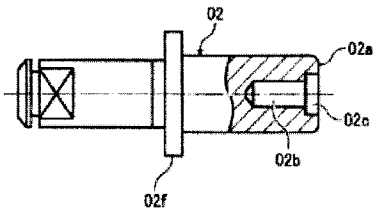
FIG. 11 (Prior Art)
FIG. 11 is a side view illustrating a part of the driving shaft in section for use in the rotation shaft 010 of the prior art toner carrier screw OA.
Figure 12:
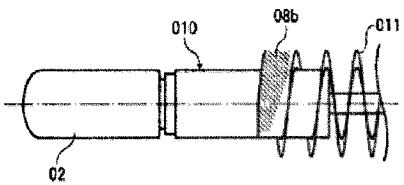
FIG. 12 (Prior Art)
FIG. 12 is a side view illustrating a problem to be solved in the prior art toner carrier screw OA.

As described above, in this Embodiment 1, the supporting shaft 40 is welded to the driving shaft 30 by the welding, so that it becomes unnecessary to form a spot facing portion (refer to FIG. 11) in the hole of the driving shaft 30 required for enhancing the joining strength, compared to the conventional joining by soldering. Moreover, the operation which applies the solder over the entire circumference of the supporting shaft 40 becomes unnecessary. Accordingly, the supporting shaft welding process in this embodiment is excellent in productivity and workplace environment because the scattering of the flux is less.

b) Joining of Coil 50, Driving Shaft 30 and Supporting Shaft 40

When joining the coil 50 and the driving shaft 30, a rotation shaft inserting process is at first performed. In this rotation shaft inserting process, the rotation shaft 10 in which the driving shaft 30 and the supporting shaft 40 are integrated as described in the above a) is inserted into the spiral shaft center portion from the base end portion side of the coil 50. Moreover, the insertion portion 32 of the driving shaft 30 is inserted into the spiral shaft center portion of the coil 50 until the side face 31*c* of the small-diameter flange portion 31*b* of the driving shaft 30 has contact with the thick portion 52 of the base end portion of the coil 50. If the thick portion 52 has contact with the side face 31*c* of the small-diameter flange portion 31*b*, the coil 50 and the rotation shaft 10 can be relatively positioned.

Next, a thick portion welding process is performed. In this thick portion welding process, at first, the thick portion 52 is welded to the outer circumference 32*b* of the insertion portion 32 of the driving shaft 30. In this case, since the thick portion 52 has contact with the flange 31, the high heat in the welding is transferred to the flange 31. This flange 31 has the small-diameter flange 31*b* and the large-diameter flange 31*a*, so that the heat capacity of the flange 31 is high and the flange 31 hardly deforms, compared to a case in which the flange portion has only one flange. Both of the flange potions 31*a*, 31*b* have a difference in the diameter, so that the outer circumference of the flange 31 has a difference in level. By this difference in level, the heat transfer and the transfer of the mechanical deformation can be prevented. Therefore, the deformation of the small-diameter flange portion 31*b* by the heat can be controlled, and the deformation is not transferred to the large-diameter flange portion 31*a*.

Next, a turned end portion joining step is performed. In this turned end portion joining step, the turned end portion 51 of the coil 50 is joined to the leading end portion of the supporting shaft 40. However, in this Embodiment 1, both of them are joined by welding. In Embodiment 1, as described above, the supporting shaft 40 has a diameter relatively smaller than that of the driving shaft 30. Thus, the turned end portion 51 of the coil 50 does not melt at a temperature which welds the supporting shaft 40.

Effect of Embodiment 1

The following effects can be obtained in the toner carrier screw TS of Embodiment 1.

a) The thick portion 52 is provided in the coil 50, and the coil welded portion 70 is formed by welding the thick portion 52 to the driving shaft 30. Therefore, the melting of the coil 50 in the welding can be controlled, and the coil 50 and the driving shaft 30 can be welded. By this welding, the joining strength can be easily improved compared to the conventional joining by soldering, so that the productivity can be improved. Namely, in order to enhance the joining strength by the conventional soldering, it is necessary to apply the solder over a sufficient area along the spiral coil, but such an operation becomes unnecessary. When the antioxidant process is performed to the driving shaft, a cleaning process is required after the soldering, but such an operation becomes unnecessary. Moreover, in the welding, flux is hardly generated in the soldering, so that the operation environment can be improved. Additionally, in the joining by the soldering, if the spiral pitch of the coil 50 is narrow, there may be a case in which the applied solder fills in the spiral groove of the coil 50, but such a problem can be prevented in this embodiment, and also the toner carrying performance can be improved. Furthermore, the heat treatment such as a nitriding treatment and the surface treatment may be applied to the driving shaft 30 of the toner carrier screw TS for use in the development device A. Conventionally, the surface of the driving shaft 30 was shaved for improving the adhesive performance of the solder. However, since the joining is conducted by the welding in Embodiment 1, the shaving of the surface becomes unnecessary. Therefore, the surface property such as corrosion resistance is not lost and the deterioration in the toner quality by rust can be reduced.

b) The coil welded portion 70 is joined to the driving shaft 30 at a single point of the base end portion of the coil 50, so that it is excellent in productivity, compared to a coil 50 in which a plurality of portions are welded.

c) The flange 31 of the driving shaft 30 is provided with the large-diameter flange portion 31*a* which has contact with the developer tank 21 and the small-diameter flange portion 31*b* which neighbors the large-diameter flange portion 31*a*, and the outer circumference of the flange 31 has a difference in level. By this configuration, when the high heat in the welding of the thick portion 52 of the coil 50 is transferred to the flange 31, the deformation to be generated in the large-diameter flange portion 31*a* can be controlled. In this case, the large-diameter flange portion 31*a* is a portion which has contact with the developer tank 21 upon the rotation of the toner carrier screw TS. Therefore, by controlling the deformation of the large-diameter flange portion 31*a*, a negative effect on the rotation of the toner carrier screw TS by the deformation of the large-diameter flange portion 31*a* can be controlled, and the rotation performance of the toner carrier screw TS can be preferably maintained.

d) In order to join the driving shaft 30 and the supporting shaft 40, the supporting shaft 40 is welded to the small-diameter portion 34 of the driving shaft 30 by the supporting shaft welded portion 60. For this reason, the difference between the diameter of the supporting shaft 40 and the diameter of the welding target portion is controlled, and the supporting shaft 40 can be welded without melting by the high temperature. As described above, the driving shaft 30 and the supporting shaft 40 are joined by the welding, so that the productivity can be improved, compared to a case in which the joining is conducted by the conventional soldering. Especially, in the conventional soldering, it is necessary to form a spot facing portion around an opening of the supporting shaft 40 in which the driving shaft 30 is inserted for improving the joining strength, but the spot facing portion becomes unnecessary. Therefore, the joining strength can be ensured while improving the productivity.

e) Since the supporting shaft welded portion 60 is welded at a single point in the circumferential direction of the supporting shaft 40, the melting down of the supporting shaft 40 can be controlled, compared to the welding in the entire circumference and a plurality of portions, and the productivity can be improved compared to the welding in the plural points.

g) With the above a), b), c), the productivity of the toner carrier screw TS can be improved, so that the development device A with reduced cost and the image forming device B using the same can be provided.

Other Embodiments

Hereinafter, other embodiments will be described. However, other embodiments are modified examples of Embodiment 1, so that the difference will be only described, and the same reference numbers are applied for the configurations which are common to Embodiment 1 or other embodiments.

Embodiment 2

Figure 6:
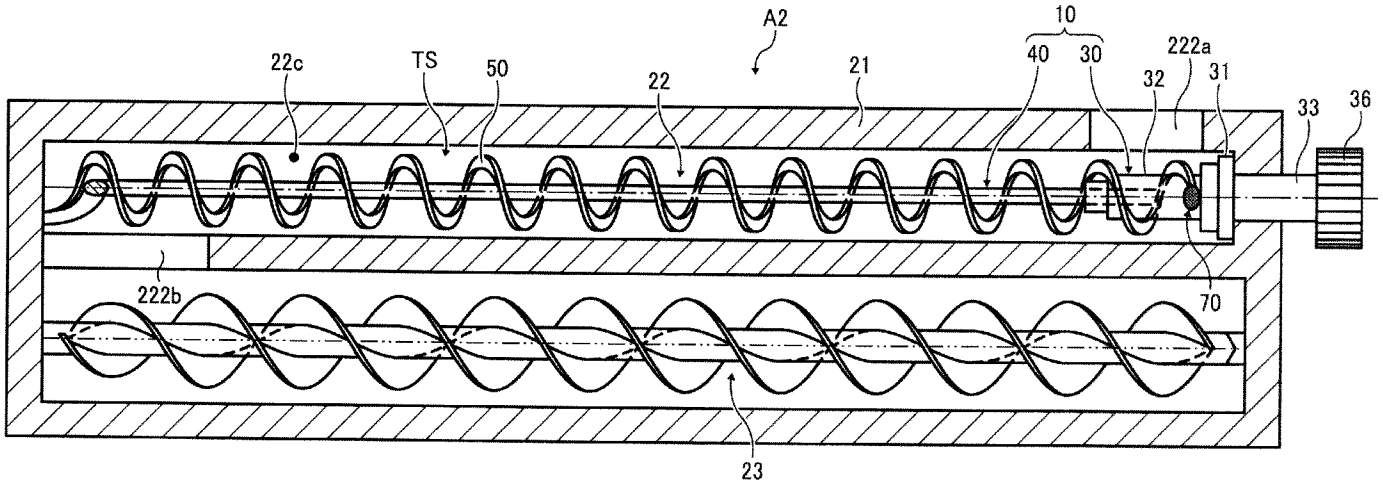
FIG. 6 is a sectional view illustrating Embodiment 2 in which the toner carrier screw TS of Embodiment 1 is introduced in another development device A2.

FIG. 6 is a view illustrating an example in which the toner carrier screw TS of Embodiment 1 is applied to the development device A2. In this development device A2, a toner entrance 222*a* is provided on the driving shaft 30 side of the toner carrier screw TS and a toner exit 222*b* is provided on the side opposite to the driving shaft 30 side, in the toner carrier 22.

In this development device A2, the toner entrance 222*a* is arranged in the position of the coil welded portion 70 which joins the coil 50 to the driving shaft 30. In this arrangement, if the driving shaft 30 and the coil 50 are joined by the conventional soldering, the toner path formed by the spiral coil 50 is narrowed by the soldering, so that there may be a case in which the toner carrying performance is deteriorated. In this Embodiment 2, the coil 50 is joined to the driving shaft 30 in the position of the flange 31 by the single point of the coil welded portion 70. Therefore, the deterioration in the toner carrying performance can be controlled.

Embodiment 3

Figure 7:
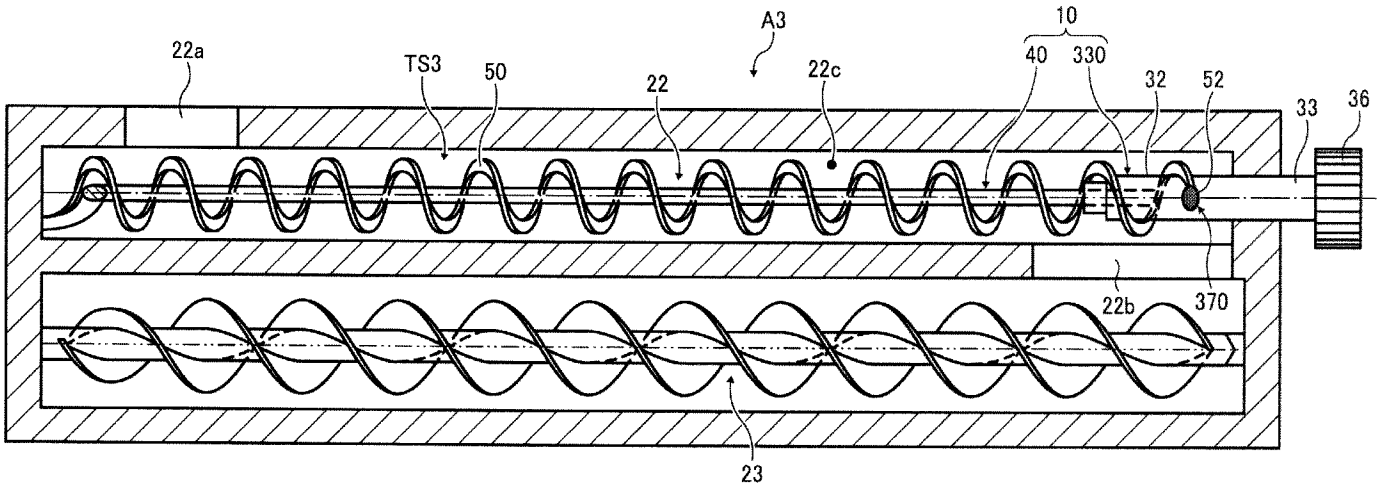
FIG. 7 is a sectional view illustrating a development device A3 in which a toner carrier screw TS3 of Embodiment 3 is introduced.
Figure 8:
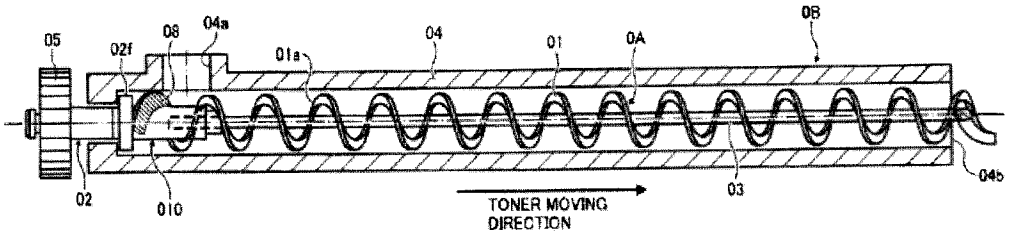
FIG. 8 (Prior Art)
FIG. 8 is a sectional view illustrating a toner carrier device OB in which a prior art toner carrier screw OA invented by the present inventor is introduced.
Figure 9:
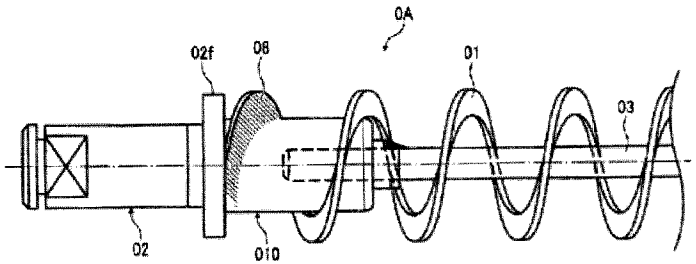
FIG. 9 (Prior Art)
FIG. 9 is a side view illustrating a main portion of the prior art toner carrier screw OA.
Figure 10:
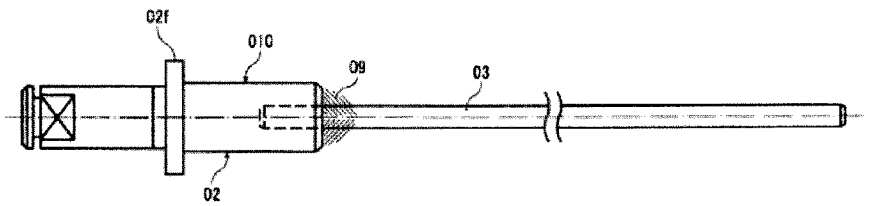
FIG. 10 (Prior Art)
FIG. 10 is a side view illustrating a rotation shaft 010 of the prior art toner carrier screw OA.

FIG. 7 is a sectional view illustrating the development device A to which a toner carrier screw TS3 of Embodiment 3 is applied. The toner carrier screw TS3 of Embodiment 3 is different from that of Embodiment 1 in a driving shaft 330. As illustrated in FIG. 7, the driving shaft 330 does not have the flange 31 illustrated in Embodiment 1.

In Embodiment 3, the thick portion 52 of the coil 50 is welded to the outer circumferential face of the insertion portion 32 of the driving shaft 330, so that a coil welded portion 370 is formed. As described above, since the coil 50 is provided with the thick portion 52, even if the coil 50 is welded only in the outer circumference of the insertion portion 32 of the driving shaft 330, the melting of the coil 50 is controlled, compared to a case in which the band-like coil without having the thick portion is welded, and the coil 50 can be joined to the driving shaft 330 by the welding.

Although the powder carrier screw of the present invention has been described according to Embodiments 1-3, the present invention is not limited thereto. It should be appreciated that variations may be made in the embodiments described by persons skilled in the art without departing from the scope of the present invention.

For example, in Embodiments 1-3, the toner is used as the powder, but the powder is not limited to the toner, and another powder such as developer can be used.

As a rotation shaft, the rotation shaft having the large-diameter driving shaft and the small-diameter supporting shaft is illustrated in Embodiments 1-3, but it is not limited thereto. For example, as a rotation shaft, a shaft having a uniform outer diameter as a whole can be used, or a shaft having a diameter smaller than that in Embodiments 1-3 for the supporting shaft can be used.

In Embodiments 1-3, as a rotation shaft, the example in which the supporting shaft is fitted to the supporting shaft fitting hole of the driving shaft is illustrated for joining the supporting shaft to the driving shaft, but it is not limited thereto. For example, a configuration which does not fit the base end of the supporting shaft to the shaft center of the driving shaft can be used. Moreover, for example, a structure having the turned end portion in which the base end portion of the supporting shaft is welded to the outer circumference of the driving shaft, and the general portion matches the shaft center of the driving shaft can be used. In Embodiments 1-3, the driving shaft and the supporting shaft are joined by the supporting shaft welded portion 60, but they can be joined by another joining method such as soldering.

In Embodiments 1, 2, the first flange portion of the flange is the small-diameter flange portion 31*b*, and the second flange portion is the large-diameter flange portion 31*a*. However, the measurement relationship can be changed such that the first flange becomes a large diameter and the second flange becomes a small diameter. The first flange and the second flange can be formed independently.

In Embodiments 1, 2, the thick portion 52 has contact with the small-diameter flange portion 31*b*, but the thick portion can be disposed in a position separate from the second flange portion as long as the heat of the thick portion can be transferred to the second flange.

According to the above embodiments, the thick portion on one end of the coil is formed to have a thickness larger than that of the general portion of the coil. For this reason, when the coil welded portion is formed by welding the thick portion on one end of the coil to the driving shaft, even if high heat required for welding the driving shaft is applied to the coil, the melting of the coil can be controlled, compared to a case in which the general portion of the coil is welded, enabling the joining by the welding. As described above, since the coil and the driving shaft can be joined by welding, the joining strength can be improved, compared to the joining by soldering. In addition, the joining operation is facilitated, so that the productivity can be improved. Moreover, the generation of flux can be reduced, so that the operation environment the manufacturing can be improved. Furthermore, the spiral groove is not filled by the applied solder as in the joining by the soldering, so that the sectional area of the groove can be maintained even if the spiral pitch of the coil is narrow. Accordingly, the toner carrying performance can be ensured. In the welding, even if the heat treatment such as a nitriding treatment and the surface treatment are applied to the surface of the rotation shaft, it is not necessary to shave the surface as in the soldering. Therefore, such an operation can be omitted. Thus, the deterioration in the toner quality by the rust generated by the deterioration in the abrasion resistance and the corrosion resistance of the shaved portion can be controlled.

According to the above embodiments, when joining the thick portion to the rotation shaft, the high heat is transferred to the flange with which the thick portion has contact. This flange has the first flange portion and the second flange portion. Thereby, the heat capacity of the flange can be improved, compared to a flange having one flange portion, so that the deformation of the flange by the heat can be controlled. Moreover, the outer circumference of the flange has a difference in level by the first flange portion and the second flange portion having a difference in the outer diameter, and by this difference in level, the transfer of the mechanical deformation and the heat transfer from the first flange portion to the second flange portion are controlled. Therefore, if the second flange portion has contact with the container which rotatably supports the powder carrier screw, the rotation performance of the powder carrier screw can be preferably maintained, compared to a case in which the second flange portion is deformed by heat.

According to the above embodiments, the rotation shaft is formed to have a relatively large diameter, and includes the driving shaft into which a rotation driving force is input and the supporting shaft concentrically joined to the driving shaft. The outer circumference of the driving shaft is provided with the coil welded portion to which the thick portion is welded. As described above, since the rotation shaft includes the driving shaft having a relatively large diameter and the supporting shaft having a relatively small diameter, the weight of the rotation shaft can be reduced and the consumption energy along with the rotation can be reduced, compared to the rotation shaft in which all of the rotation shafts are formed to have a diameter which is the same as that of the driving shaft. On the other hand, compared to the rotation shaft in which all of the rotation shafts are formed to have a diameter which is the same as that of the supporting shaft, the strength of the rotation shaft can be ensured and the transferring performance of the rotation driving force can be also ensured.

Moreover, since the thick portion is formed in the coil, even if the coil is welded to the large-diameter driving shaft, the welding can be conducted.

According to the above embodiments, the operation which matches the shaft center of the driving shaft to the shaft center of the driving shaft is simple because the supporting shaft is fitted to the supporting shaft fitting hole of the driving shaft, and is superior in an operation performance. Since the supporting shaft has contact with the supporting shaft fitting hole without having a space over the entire circumference, the supporting shaft can be effectively welded to the driving shaft even if the supporting shaft is welded to any position on the circumference of the driving shaft. Moreover, the driving shaft and the supporting shaft are joined by the welding, so that the productivity can be improved, compared to the joining by the soldering.

According to the above embodiments, since the supporting shaft is welded to the small-diameter portion of the driving shaft, the temperature which welds the driving shaft can be lowered, compared to a case in which the supporting shaft is welded to the driving shaft without having the small-diameter portion. Consequently, a phenomenon in which the supporting shaft melts down by the excessive high heat of the supporting shaft can be controlled.

According to the above embodiments, the powder carrier screw having any of the above effects can be applied to a development device. The development device including the powder carrier screw having any of the above effects can be also applied to an image forming device such as a copier, a printer and a facsimile.

What is claimed is:

1. A powder carrier screw, comprising:

a rotation shaft extending in an axial direction through a path which carries powder such as toner, the rotation shaft being rotatably supported by a container forming the path, the rotation shaft having one end from which a rotation driving force is applied;

a coil which is provided in a spiral form along an outer circumference of the rotation shaft, the coil including a general portion consisting of a material of a certain thickness wrapped around the rotation shaft, the coil having a shaft center of the rotation shaft as a coil shaft center and having both end portions of the coil joined to both end portions of the rotation shaft, and the coil rotating along the rotation of the rotation shaft;

a thick portion which is provided in at least one end portion of the coil in the axial direction, the thick portion having a thickness larger than said certain thickness of the general portion of the coil; and a coil welded portion in which the thick portion and the rotation shaft are welded, wherein the rotation shaft has a flange on at least a portion of the outer circumference of the rotation shaft, the thick portion is located in a position capable of transferring heat to the flange in the welding of the thick portion to the rotation shaft, the flange includes a first flange portion arranged at a first position along the axial direction and a second flange portion arranged at another position along the axial direction which is relatively further, as compared to the first position, in the axial direction from the thick portion, an outer diameter of the first flange portion is different than an outer diameter of the second flange portion, and the outer diameter of the first flange portion is larger than an outer diameter of the rotation shaft to which the thick portion is welded.

2. The powder carrier screw according to claim 1, wherein the rotation shaft includes a driving shaft having one end to which the rotation driving force is applied and a supporting shaft which is formed in a shaft form having a diameter smaller than that of the driving shaft, is concentrically joined to an other end of the driving shaft, and rotates together with the driving shaft, and the coil welded portion is formed in an outer circumference of the driving shaft.

3. The powder carrier screw according to claim 1, comprising:

a supporting shaft fitting hole formed in a shaft center of the other end of the driving shaft; and a supporting shaft welded portion in which an outer circumference of the supporting shaft and a circumference of an opening portion of the supporting shaft fitting hole are joined by welding in a state in which the supporting shaft is fitted to the supporting shaft fitting hole.

4. The powder carrier screw according to claim 3, wherein the other end of the driving shaft includes a small-diameter portion having a diameter smaller than that of a general portion of the driving shaft and the supporting shaft fitting hole, and the supporting shaft welded portion is formed by welding the small-diameter portion and the supporting shaft.

5. A development device, comprising;

a container forming a path which carries developer including toner; and the powder carrier screw according to claim 1 rotatably supported to the container.

6. An image forming device comprising the development device according to claim 5.

7. The powder carrier screw according to claim 1, wherein the rotation shaft has a flange on an outer circumference thereof, the thick portion is located in a position capable of transferring heat to the flange in the welding of the thick portion to the rotation shaft, and the thick portion is welded to a portion of the rotation shaft other than the flange.

8. The powder carrier screw according to claim 1, wherein the thick portion and the rotation shaft are welded such that a tip of said at least one end portion of the coil contacts the rotation shaft at a single point.

9. The powder carrier screw according to claim 1, wherein an inner portion of the coil closest to the rotation shaft and adjacent to the thick portion is not welded to the rotation shaft.

10. The powder carrier screw according to claim 1, wherein the outer diameter of the second flange portion, which is relatively further, as compared to the first flange portion, in the axial direction from the thick portion, is larger than the outer diameter of the first flange portion.

* * * * *